United States Patent [19]

Friedrich

[11] 4,438,963

[45] Mar. 27, 1984

[54] DOOR LATCH MECHANISM WITH GENERALLY LINEARLY MOVABLE OPERATING MEMBER

[76] Inventor: Peter Friedrich, 44 Riverside Ave., Lyndhurst, N.J. 07071

[21] Appl. No.: 277,876

[22] Filed: Jun. 26, 1981

[51] Int. Cl.[3] ..... E05C 1/16

[52] U.S. Cl. ..... 292/168; 292/153; 292/336.3; 292/146

[58] Field of Search ..... 292/140, 146, 153, 154, 292/168, 170, 169.14, 169.18, 197, 336.3; 70/487, DIG. 80

[56] References Cited

U.S. PATENT DOCUMENTS

| | | | |
|---|---|---|---|
| 560,697 | 5/1896 | Dustin . | |
| 1,215,843 | 2/1917 | Painter, Jr. et al. | 292/168 |
| 1,965,939 | 7/1934 | Jacobi | 292/170 |
| 2,186,666 | 1/1940 | Cereda | 292/153 |
| 2,233,828 | 3/1941 | Anderson . | |
| 2,473,052 | 6/1949 | Cordrey et al. . | |
| 2,504,483 | 4/1950 | Abraham | 292/153 |
| 3,212,806 | 10/1965 | Russell et al. | 292/336.3 |
| 3,249,379 | 5/1966 | Ross . | |
| 3,439,514 | 4/1969 | Lee | 292/170 |
| 3,655,230 | 4/1972 | Armstrong . | |
| 3,737,184 | 6/1973 | Swartz . | |
| 3,785,686 | 1/1974 | Armstrong . | |
| 3,853,340 | 12/1974 | Arfelt et al. . | |
| 3,909,051 | 9/1975 | Nakai | 292/153 |
| 4,007,954 | 2/1977 | Erickson . | |
| 4,040,652 | 8/1977 | Arfelt et al. . | |

*Primary Examiner*—Thomas J. Holko
*Assistant Examiner*—Neill Wilson
*Attorney, Agent, or Firm*—Brumbaugh, Graves, Donohue & Raymond

[57] ABSTRACT

A door latch mechanism with a vertically linearly translatable operating member that is manually movable to unlatch a door. The mechanism, which includes a locking assembly, is locked by rotational movement of the operating member. A foil member connects with the operating member centrally and has ends wound into chambers. The foil, movable with the operating member vertically, closes a slot in which the operating member moves. The connection of the operating member with the foil permits rotational movement for locking. A rotational latch cooperates to hold the operating member in its rotated, locked position, against the bias of springs urging unlocking rotational movement of the operating member.

16 Claims, 7 Drawing Figures

DOOR LATCH MECHANISM WITH GENERALLY LINEARLY MOVABLE OPERATING MEMBER

BACKGROUND OF THE INVENTION

This invention relates to a door latch mechanism with a generally linearly translatable operating member manually movable to unlatch a door. More particularly, this invention relates to a door latch operating mechanism and lock assembly with a manually operable linearly translatable member or handle that translates linearly to unlatch the door and rotates to lock the mechanism.

Aside from the ordinary rotatable door knob, numerous door latch mechanisms have been proposed with a handle that pivots to move a latch or bolt from a latched to an unlatched position. The handles have often protruded well from the face of the door and have often been without locking arrangements. Many mechanisms with rotatable knobs, pivotal actuators, or unconventional bolt actuators have been difficult for the physically handicapped to grasp and operate, as have been the locking provisions, when these have been provided.

BRIEF SUMMARY OF THE INVENTION

In accordance with this invention, a door latch mechanism has a generally linearly translatable operating member or handle easily movable on one or both sides of the door parallel the face of the door. The entire exposed portion of the mechanism has a low profile with respect to the door face on which it is mounted. The operating member is easily manually engaged and moved by those suffering such physical handicaps as severe arthritis or partial paralysis affecting the use of the hand, and so is well suited for use in hospitals, therapeutic centers, nursing homes and the like.

Contrary to ordinary door latch mechanisms, according to this invention either operating member is manually rotatable to lock the mechanism. On at least one side of the door, a simply operated push button unlocks the mechanism. This is accomplished by freeing an internal rotational latching arrangement to allow biased rotational movement of the rotated operating member to its unlocked position. In a preferred embodiment, the mechanism can thus be locked from either side of the door, but is readily unlocked by the push button on just one side, ordinarily the inside. On the outside, the operating member can be equipped with an opening providing access to the internal rotational latch to free the operating members for rotational movement back to the unlocked condition. The operating member clearly displays its locked or unlocked condition at relatively great distances.

According to one aspect of the invention, the door latch mechanism fits doors of various thicknesses. Telescopic extensions of drive members communicate between the actuating members on the opposite faces of the door and engage and operate a standard spring biased bolt assembly. These telescopic extensions are adapted for mutual rotation so that rotation of either operating member effects locking by rotating a noncircular locking member to a position crosswise in an enlarged area of a slot formed in a blocking member. Disposed crosswise of the slot, the noncircular member cannot move therein as it ordinarily would during unlatching. This, then, prevents linear translation to unlatch the door. A rotational latch has a rotatable plate with at least one, but preferably several, latching projections formed on it. A cam surface at one edge of each projection and a latch surface at an opposite edge allow the projections to move past stationary detents located in the path of rotational movement of the latch projections. When the latch plate is rotated with the operating member and the noncircular member, the cam surfaces on the projections ride over the detents and, under the bias of a spring, the projections on the latch plate return into latching engagement with the detents to latch the noncircular member against rotation away from its crosswise, locked position. Leaf springs engage another noncircular surface, urging rotational return of the mechanism to its unlocked condition. Acting through a lever, the push button on one of the operating members pivots the rotatable latch plate to remove its projections from latched engagement with the stationary detents, permitting the plate, the noncircular locking member, and the operating members to rotate under the urging of the leaf springs. An opening in the remaining operating member, a lever, and a pin extending through the telescopic extensions can be used to pivot and release the rotational latch for emergency unlocking from the outside of the door.

Both operating members translate in slots in plates mounted on the door faces. These slots are closed by foil coverings connected to the operating members. Ends of foil covering are spirally wound into chambers at the slot ends to allow unwinding and rewinding when the operating members are moved linearly. The operating members are connected to the foil to permit rotational movement relative to the foil. Only attractive slotted face plates, the operating members (with button or hole), and the foil are visible on the door faces.

The above and further objects and advantages of the invention will be better understood with reference to the following detailed description of a preferred embodiment taken in consideration with the accompanying drawings.

DESCRIPTION OF PREFERRED EMBODIMENT

Figure 1:
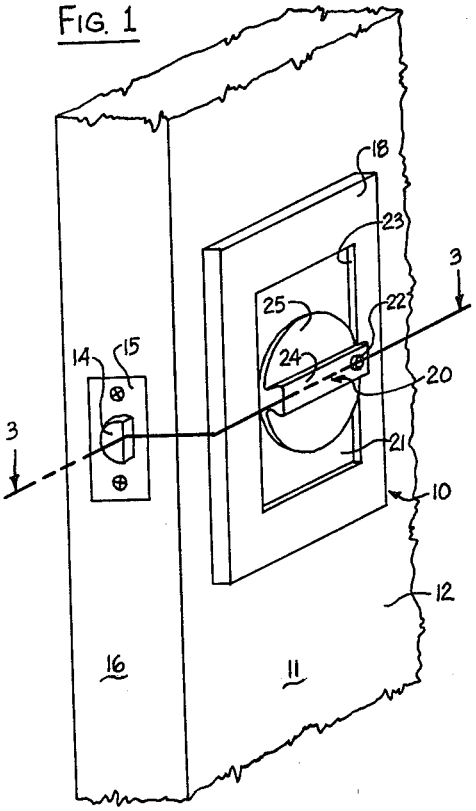
FIG. 1 is a fragmentary perspective view of a door equipped with a door latch mechanism according to the invention.

FIG. 1 illustrates one side of the external portions of a door latch mechanism 10 affixed to one face 11 of a door 12. The tapered end of a conventional bolt 14 is seen extending through a plate 15 mounted on the door edge 16. The external features of the door latch mechanism 10 shown in FIG. 1 include a face plate 18, a linearly translatable operating member or handle 20, a foil covering 21 and an unlock button 22.

The operating member 20 is vertically movable from a central, at-rest position, as shown, to upper and lower extremes of a rectangular slot 23 in the face plate 18. The handle 20 includes a horizontally extending bar-like portion 24 projecting from a circular base 25. Described in greater detail below, the base 25 is attached to the foil 21 and is rotationally movable relative to the foil to lock the mechanism 10.

Figure 3:
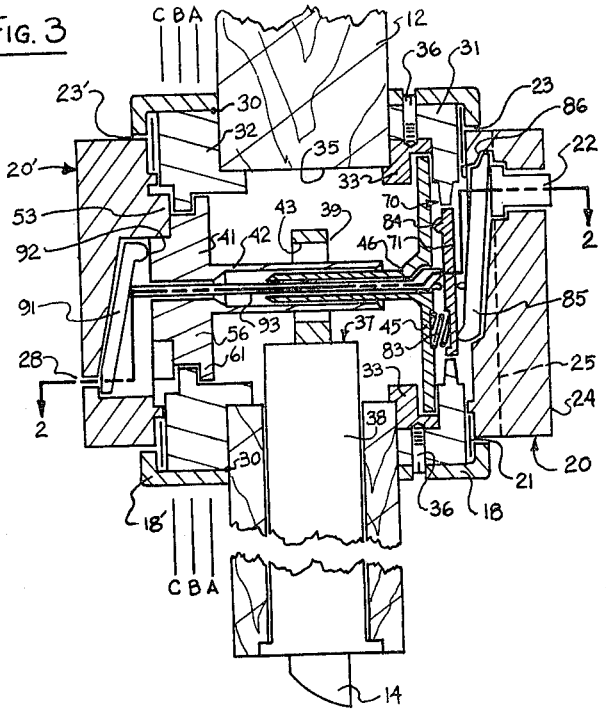
FIG. 3 is an enlarged fragmentary cross-sectional view taken along the line 3—3 in FIG. 1 and shows the rotational latching plate, the unlatching button and the levers for unlocking.
Figure 2:
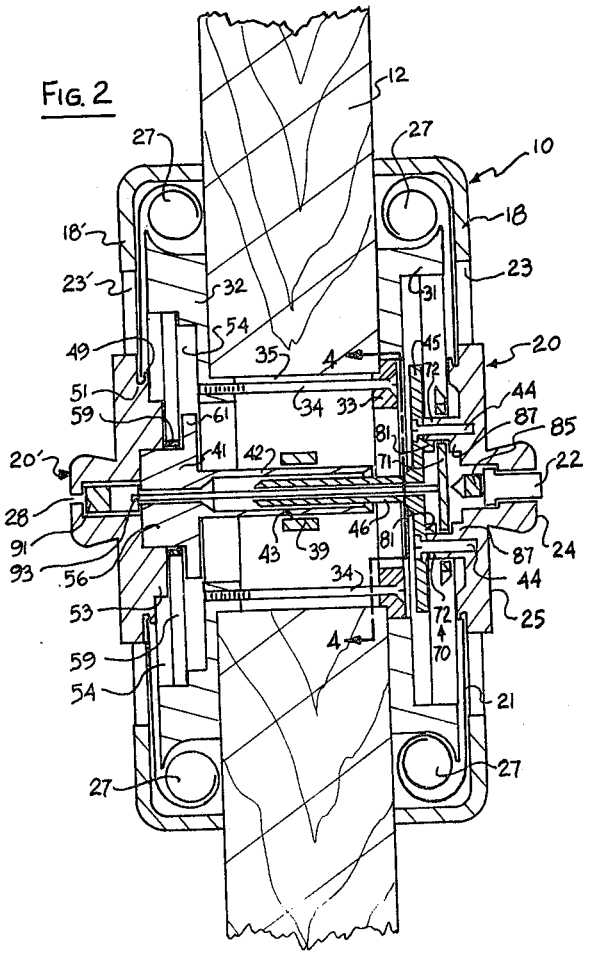
FIG. 2 is a fragmentary cross-sectional view taken along the line 2—2 in FIG. 3 and shows the interrelationships of the linearly translatable actuating members and the door latch operating provisions.

As seen in FIGS. 1, 2, and 3, the mechanism 10 is unlocked. In FIG. 2, ends of the foil 21 can be seen helically wound into a pair of chambers 27 in face plates 18 and 18' on the faces of the door 12. Inherent memory of the foil 21 can provide easy, helical rewinding each time a handle is moved vertically. On the opposite face of the door from the handle 20 can be seen a second, similar operating member 20'. This operating member differs in being equipped with a small opening 28 to receive some suitable probe for emergency unlocking. The operating member 20' is vertically translatable in a slot 23' in a second face plate 18'. A pair of main frame elements 31 and 32, a support ring 33, and several ring screws 34 affix the mechanism to the door 12 in cooperation with a bore 35 through the door. The screws 34 can be provided in several sizes to accommodate several standard door thicknesses, or to this same end, the screws can be made frangible at several points. Recessed Allen head screws 36 (FIG. 3) retain the plate 18 and the main frame element 31 on the ring 33. Similar screws can retain the remaining frame element 18, or this can be affixed by spot welds 30, by crimping, by brazing, by internal, hidden fasteners or other means, in which latter cases the entire subassembly associated with the handle 20 can be prefabricated to be easily slipped into place. Provision of accessible set screws at just the one frame element 18 is, then, sufficient for disassembly, and the mechanism can only be removed from one side of the door 12. Where security is a concern, no means of disassembling the mechanism is available at the outside face of the door, and in this case, a handle 20' without an opening 28 can be provided.

Figure 4:
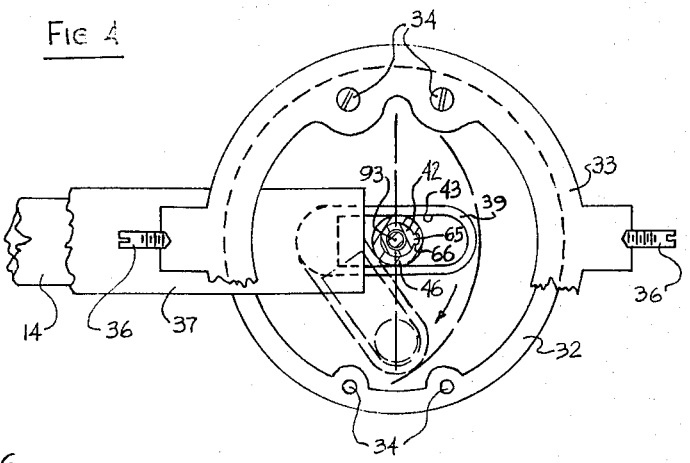
FIG. 4 is a fragmentary cross-sectional view along the line 4—4 of FIG. 2, with parts broken away, and shows the relationship of the telescoping extensions and the bolt assembly.

In FIGS. 3 and 4 a conventional door latch or bolt assembly 37 is schematically illustrated. This assembly includes the bolt 14, a housing 38, a conventional internal biasing means (not shown), and a slotted bolt actuator 39. Pivotal movement of the bolt actuator 39 from the central position to which it is biased, and in the direction of the unnumbered arrows associated with the bolt actuator in FIGS. 2 and 4, retracts the bolt 14. Affixed to handle 20', a first drive member 41 (FIGS. 2 and 3) has a tubular extension 42 extending coaxially into the bore 35 through a slot 43 in the bolt actuator 39. Affixed to the other handle 20 by suitable screws or studs 44 (FIG. 2), a second drive member 45 has a second tubular extension 46 extending coaxially into the bore 35 and telescopically received in the first mentioned tubular extension 42. Generally linear translation of either handle 20 or 20', up or down, will pivot the bolt actuator 39 to retract the bolt 14.

Figure 5:
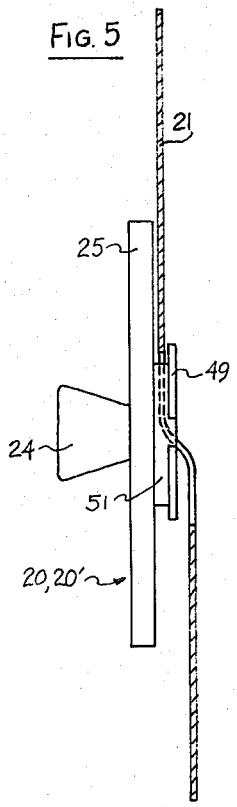
FIG. 5 is an elevational view, partly in section, showing the manner of attaching a foil to the linearly movable handle or operating member.

The bases 25 of each of the handles 20 and 20' are equipped with four lips 49 that retain the foil 21. FIG. 5 illustrates an example of such an arrangement There, a base 25 of an operating member 20 or 20' is shown with an inwardly projecting ring 51 on which the lips 49 are formed. The foil 21 has a central circular opening slightly larger than the circumference of the ring 51 and slightly smaller than the measurement across the lips or lugs. To assemble, the edge of the opening in the foil is slipped over one and then a neighboring lip and into engagement with the ring. The remaining half of the circular opening is then slipped over the remaining two lips in similar fashion and the foil is thus securely held. This manner of fastening the foil and the handles permits rotational movement of the handles relative to the foil for locking.

Figure 6:
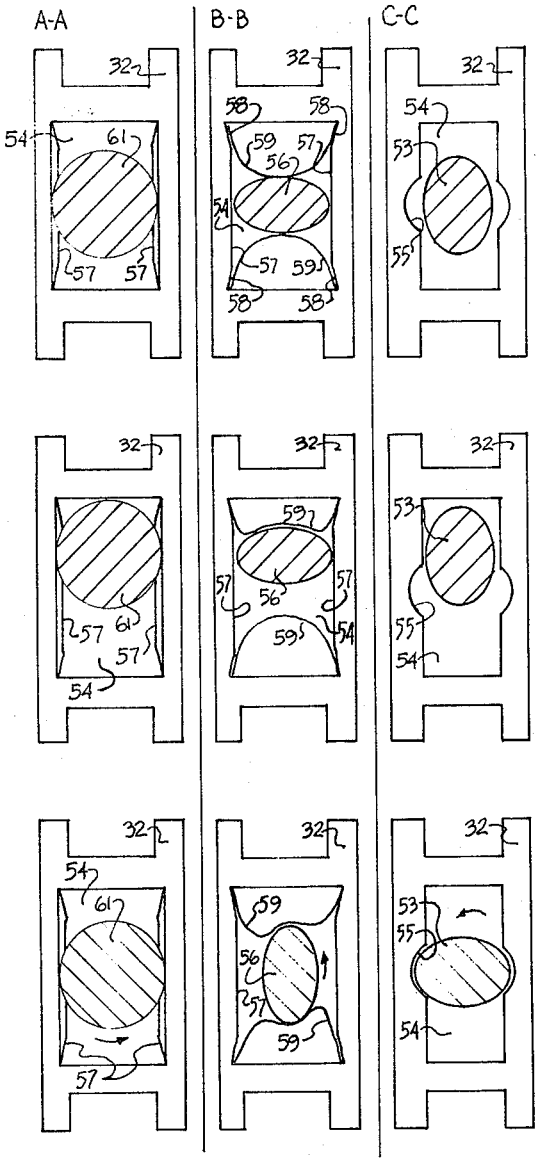
FIG. 6 is a schematic illustration of the cross-sections of the linear translation guiding, spring biasing, and rotational locking provisions of the latch mechanism in its unlocked, unlatched, and locked conditions.

For locking, an inwardly projecting portion of the handle 20' constitutes a noncircular locking member 53 (FIGS. 2 and 3). In FIG. 6, at C—C, three positions of the noncircular member 53 are diagrammatically illustrated as they would be seen taken along the line C—C of FIG. 3 with mechanism, from top to bottom, latched but unlocked, then unlatched, and then locked. The main frame element 32 is slotted in the direction of linear translation of the handles to form a slot 54 with a centrally enlarged portion 55 capable of receiving the elliptical surface of the noncircular locking member 53 in its rotated, locking position, as shown in the lowermost illustration of FIG. 6 C—C. So-rotated, the elliptical or noncircular inwardly projecting member 53 of the handle 20' is incapable of moving either upward or downward to unlatch the bolt 14. The main frame element 32 acts as a blocking member preventing translation of the linearly movable parts. The entire mechanism is thus locked.

As shown in FIGS. 2 and 3, the first drive member 41 forms yet another noncircular portion 56. Schematically shown at B—B in FIG. 5, the outer surface of this portion 56 is movable between surfaces 57 of the slot 54 in the main frame element 32. The surface 57 has outwardly diverging sides 58 at its ends that house leaf springs 59. The leaf springs bias the drive member 41 to its central position, and when, in locking, drive member 41 is rotated, the leaf springs act against the noncircular surface of the portion 56 to bias the drive member rotationally back towards its unlocked position, when the portion 56 is turned slightly. Rotated to the locked position, the elliptical shape of the portion 56 can be in a stable, on-center position between the springs. On the other hand, a slight asymmetry on the ellipse or other noncircular surface can engage one of the springs to tend to return the rotated parts of the mechanism or the springs can be located out of alignment to the same end.

Finally, a further portion 61 of the drive member 41 is circular in cross-section and is shown at FIG. 6, A—A. This portion slides in the slot 54 to guide the drive member 41 and the handle 20' for translational movement up or down. Surface 57 forms a flange along the length of slot 54 to retain the drive member 41 and the handle 20' to which it is secured. Drive member 41 and handle 20' act as a channel to frame the flange 57.

The telescopic relationship of the extensions 42 and 46 transmit upward and downward lateral translation from one handle to the other. Likewise, rotational movement of one handle is transmitted to the other. The extensions 42 and 46 are keyed together in any convenient way. For example, in the illustrated embodiment, as seen in FIG. 4, the extension 46 has a key 65 secured along its outer surface and received in a slot 66 in the inner surface of the extension 42.

Figure 7:
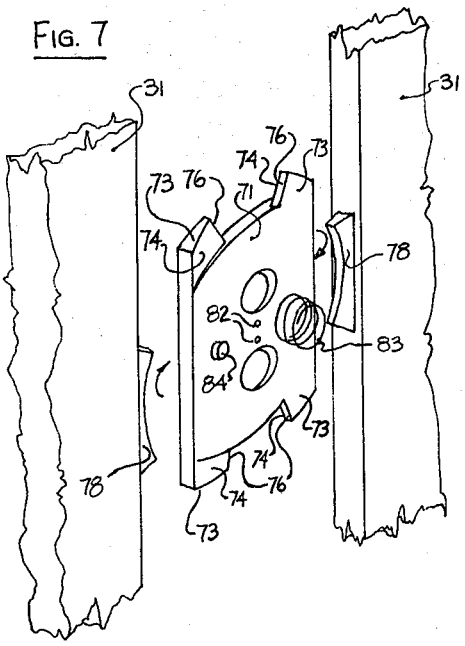
FIG. 7 is a fragmentary perspective view of the rotational latching arrangement that locks the mechanism.

Returning to FIGS. 2 and 3, adjacent the handle 20 a rotational latching arrangement 70 includes a latch plate 71. The latch plate 71 is loosely held captive on bosses 72 (FIG. 2) between the handle base 25 and the drive member 45 to provide rotational movement of the latch plate 71 with the handle and the drive member and to allow slight pivotal movement of the latch plate. The shape of the latch plate is best illustrated in FIG. 7. There, it can be seen that the plate includes four ears 73. Each of these ears has a cam surface 74, as well as a latch surface 76. A pair of detents 78 is integral with or affixed to the main frame element 31. The latch plate 71 is mounted for pivotal movement or rocking about abutting projections 81 and 87 (FIG. 2) formed on the drive member 45, and the handle 20, respectively. Projections 81 contact the latch plate 71 at the points 82 in FIG. 7. A spring 83 cooperates with a stop 84 to bias the latch plate 71 into a position coplanar with the detents 78. Rotation of the latch plate when either handle 20 or 20' is rotated to the locking position, brings the cam surfaces 74 into contact with the detents 78 to rock the latch plate 71 and permit the ears 73 to move past the detents 78 for latching engagement of the latch surfaces 76 with the top and bottom edges of the detents.

The button 22 in FIGS. 2 and 3 releases the latching arrangement 70. Depression of the button 22 pivots a lever 85 about a pivot point 86 in the direction indicated in FIG. 3. The lever 85 abuts and rocks the latch plate 71 about the projections 81 and the further pair of projections 87 to release the latch surfaces 76 of the ears 73 for return rotational movement of all of the rotational members and unlocking of the mechanism.

Unlocking from the handle 20' side of the door is effected by insertion of any suitable element in the opening 28 to pivot a lever 91 about its pivot point 92, driving a pin 93 that centrally extends through the telescoping extensions 42 and 46 to the latch plate 71. Axial driving movement of the pin 93 pivots the latch plate 71 about the projections 81 and 87 to effect unlatching and unlocking exactly as explained above. Like the ring screws 34 the pin 93 can be made of easily severed material or can be made frangible at several points along its length to permit its adaptation to several standard door widths.

While the various elements of the mechanism 10 are illustrated as metal, the parts can be molded plastic, or combinations of molded plastic and suitable metals as may be dictated by appearance and function. One particular embodiment of the invention has been described. Modifications of the exemplary embodiment, within the spirit of this invention, will be apparent to those skilled in the art. The description of the preferred embodiment, therefore, should not be taken to limit the scope of the invention, as set forth in the appended claims.

I claim:

1. A door latch mechanism including:

(a) manual operating means adapted for mounting on the face of a door and including a manually accessible operating member generally linearly translatable substantially parallel to the face of the door;

(b) a door latch assembly for location within the door between its faces, the door latch assembly including a movable door latch element for latching the door closed and operable between an extended, latched position and a retracted, released position, and door latch actuator means operatively connected to the door latch element for effecting the movement thereof;

(c) means connected between the operating member and the door latch actuator means for operating the door latch actuator means and moving the door latch element when the operating member is moved linearly;

(d) said lineraly translatable operating member being mounted for rotational movement in addition to said translation; and (e) the mechanism further comprising locking means responsive to rotational movement of the operating member for preventing retraction of the door latch element.

2. The door latch mechanism according to claim 1, wherein the locking mechanism comprises a noncircular member operatively connected to the operating member for translational and rotational movement therewith, and a fixed blocking member, said noncircular member being located for translational movement with respect to the blocking member and rotationally movable by said operating member to an interfering position of increased lateral extent for abutting the blocking member to prevent unlatching translational movement of the noncircular member and the operating member.

3. A door latch mechanism including:

(a) manual operating means adapted for mounting on the face of a door and including a manually accessible and generally linearly translatable operating member;

(b) a door latch assembly for location within the door between its faces, the door latch assembly including a movable door latch element for latching the door closed and operable between an extended, latched position and a retracted, released position, and door latch actuator means operatively connected to the door latch element for effecting the movement thereof;

(c) means connected between the operating member and the door latch actuator means for operating the door latch actuator means and moving the door latch element when the operating member is moved linearly;

(d) said linearly translatable operating member being mounted for rotational movement in addition to said translation;

(e) the mechanism further comprising locking means responsive to rotational movement of the operating member for preventing retraction of the door latch element;

(f) the locking mechanism comprising a noncircular member operatively connected to the operating member for translational and rotational movement therewith, and a fixed blocking member, said noncircular member being located for translational movement with respect to the blocking member and rotationally movable by said operating member to an interfering position of increased lateral extent for abutting the blocking member to prevent unlatching translational movement of the noncircular member and the operating member;

(g) spring means biasing said noncircular member away from said interfering position to return said noncircular member and said translatable operating member rotationally to an unlocked condition;

(h) the spring means comprising at least one leaf spring engaging a cam surface rotatable with the noncircular member; and (i) the cam surface acting with the leaf spring to bias the noncircular member and the operating member rotationally to the unlocked position and to bias said members linearly to a position along the path of translation that corresponds to the latched position of the door latch element.

4. A door latch mechanism including:

(a) manual operating means adapted for mounting on the face of a door and including a manually accessible and generally linearly translatable operating member;

(b) a door latch assembly for location within the door between its faces, the door latch assembly including a movable door latch element for latching the door closed and operable between an extended, latched position and a retracted, released position, and door latch actuator means operatively connected to the door latch element for effecting the movement thereof;

(c) means connected between the operating member and the door latch actuator means for operating the door latch actuator means and moving the door latch element when the operating member is moved linearly;

(d) said linearly translatable operating member being mounted for rotational movement in addition to said translation;

(e) the mechanism further comprising locking means responsive to rotational movement of the operating member for preventing retraction of the door latch element;

(f) the locking mechanism comprising a noncircular member operatively connected to the operating member for translational and rotational movement therewith, and a fixed blocking member, said noncircular member being located for translational movement with respect to the blocking member and rotationally movable by said operating member to an interfering position of increased lateral extent for abutting the blocking member to prevent unlatching translational movement of the noncircular member and the operating member;

(g) spring means biasing said noncircular member away from said interfering position to return said noncircular member and said translatable operating member rotationally to an unlocked condition;

(h) the spring means comprises a pair of arcuate leaf springs, arranged one on each of a generally elliptical surface of the noncircular member, the central portions of the leaf springs engaging the elliptical surface on either side in the direction of translation to bias the noncircular member and operating member to a generally central location along the path of translational movement thereof.

5. A door latch mechanism including:

(a) manual operating means adapted for mounting on the face of a door and including a manually accessible and generally linearly translatable operating member;

(b) a door latch assembly for location within the door between its faces, the door latch assembly including a movable door latch element for latching the door closed and operable between an extended, latched position and a retracted, released position, and door latch actuator means operatively connected to the door latch element for effecting the movement thereof;

(c) means connected between the operating member and the door latch actuator means for operating the door latch actuator means and moving the door latch element when the operating member is moved linearly;

(d) said linearly translatable operating member being mounted for rotational movement in addition to said translation;

(e) the mechanism further comprising locking means responsive to rotational movement of the operating member for preventing retraction of the door latch element;

(f) the locking mechanism comprising a noncircular member operatively connected to the operating member for translational and rotational movement therewith, and a fixed blocking member, said noncircular member being located for translational movement with respect to the blocking member and rotationally movable by said operating member to an interfering position of increased lateral extent for abutting the blocking member to prevent unlatching translational movement of the noncircular member and the operating member;

(g) spring means biasing said noncircular member away from said interfering position to return said noncircular member and said translatable operating member rotationally to an unlocked condition;

(h) a rotational latching member adapted for rotational movement with said operating member and said noncircular member;

(i) at least one cooperating projection located in the path of rotational movement of the rotational latching member;

(j) at least one latching cam surface on one of the rotational latching member and projection for guiding the rotational latching member past the projection to a rotationally latched position of the rotational latching member;

(k) means biasing one of the rotational latching member and projection to a latched disposition and allowing movement of the rotational latching member past the projection; and (l) unlocking means for acting against the biasing means to move one of the rotational latching member and the projection out of latched position to effect unlocking of the mechanism.

6. The latching mechanism according to claim 5, wherein said rotational latching member has projecting portions thereon each forming a latch surface and said latching cam surface, said rotational latching member is mounted for pivotal movement, said biasing means comprises a spring engaging said rotational latching member and biasing said rotational latching member against pivotal movement, said latching cam surface being engageable with said projection for acting against said spring to pivot the rotational latching member upon engagement with the projection, and the unlocking means acting against the biasing means includes a manually accessible release member operatively engaged with the rotational latching member to pivot the rotational latching member to an unlatched position.

7. A door latch mechanism including:

(a) manual operating means adapted for mounting on the face of a door and including a manually accessible and generally linearly translatable operating member;

(b) a door latch assembly for location within the door between its faces, the door latch assembly including a movable door latch element for latching the door closed and operable between an extended, latched position and a retracted, released position, and door latch actuator means operatively connected to the door latch element for effecting the movement thereof;

(c) means connected between the operating member and the door latch actuator means for operating the door latch actuator means and moving the door latch element when the operating member is moved linearly;

(d) an outer housing in which the operating member is linearly translatable in a slot; and (e) foil means attached around the periphery of the linearly translatable operating member and extending therefrom in the slot in the housing to recessed receiving chambers wherein the ends of said foil means are wound.

8. The door latch mechanism according to claim 7, wherein the operating member has lugs formed on an inwardly projecting portion, said foil means is formed with a central opening fitting closely about the periphery of the portion of the operating member and retained by said lugs.

9. A door latch mechanism including:

(a) manual operating means adapted for mounting on the face of a door and including a manually accessible and generally linearly translatable operating member;

(b) a door latch assembly for location within the door between its faces, the door latch assembly including a movable door latch element for latching the door closed and operable between an extended, latched position and a retracted, released position, and door latch actuator means operatively connected to the door latch element for effecting the movement thereof;

(c) means connected between the operating member and the door latch actuator means for operating the door latch actuator means and moving the door latch element when the operating member is moved linearly;

(d) a second manual operating means and including a second generally linearly translatable operating member;

(e) both of the first mentioned and second operating members being mounted for movement substantially parallel the face of the door and transverse to the direction of movement of the door latch;

(f) means for securing the first mentioned actuating means to one face of a door;

(g) means for securing the second manual operating means to the other face of a door; and (h) said means connected between the operating member and the door latch actuator including means communicating between the first mentioned and second operating means for operating the door latch assembly by either actuating means.

10. The door latch mechanism according to claim 9, wherein the means communicating between the first mentioned and second operating means comprises telescoping members for extending from the first and second operating means to accommodate varying door thicknesses.

11. The door latch mechanism according to claim 10, wherein the telescoping members are adapted for mutual rotational movement with first and second linearly translatable operating members of the first and second manually operable actuating means, the mechanism including locking means responsive to rotational movement of either one of the operating members for preventing retraction of the door latch element.

12. The door latch mechanism according to claim 11, wherein the locking means comprises a rotational latch member, and a nonrotational latch member, one of said latch members being movable transversely of the direction of rotational movement to unlatch and unlock the locking means, the telescoping members being tubular and having a pin communicating therethrough to the transversely movable latching member from the actuating means most remote from the latching member, whereby the locking means is unlockable from the remote actuating means.

13. A door latch mechanism according to claim 9 wherein the first mentioned and second operating members are movable upward and downward from a central, door-latched position in which the door latch element is extended, and means biasing the operating members to the central position, said upward downward movement being substantially perpendicular to the direction of movement of the door latch element between its retracted and extended positions.

14. A door latch mechanism according to claim 1 further comprising rotary latch means including a rotational latch member rotationally movable with rotational movement of the operating member, a nonrotational latch member, the rotational latch member and nonrotational latch member being located in substantially the same plane and defining latching projections having cam surfaces thereon permitting relative movement to a latched, rotated position, biasing means biasing at least one of the rotational and nonrotational latch members into latching engagement, and manual operable means operative against the bias of said biasing means to tilt at least one of the latch members to release the latching projections from latched interengagement.

15. A door latch mechanism according to claim 2 wherein the noncircular member of the locking mechanism has a longer dimension and a shorter dimension, each transverse a rotational axis of the member, and the fixed blocking member is a portion of a track extending in the direction of linear movement of the operating member and of sufficient width permitting movement therein of the noncircular member with its shorter dimension transverse the direction of linear movement, the track defining an enlarged portion thereof accepting the noncircular member with its longer dimension transverse the direction of movement and preventing linear movement out of the position until the noncircular member is rotated.

16. A door latch mechansim according to claim 15 wherein the noncircular member has thereon a second noncircular part having a longer axis angularly offset with respect to said longer axis of the noncircular member, leaf springs engaging the second noncircular part and biasing the noncircular member and part to an unlocked rotational position and to a door-latched translational position.

* * * * *